United States Patent [19]

Pink

[11] Patent Number: 4,671,078

[45] Date of Patent: Jun. 9, 1987

[54] VERTICALLY-ADJUSTABLE MEAT KEEPER FOR REFRIGERATOR

[75] Inventor: John J. Pink, Cedar Rapids, Iowa

[73] Assignee: Amana Refrigeration, Inc., Amana, Iowa

[21] Appl. No.: 882,876

[22] Filed: Jul. 7, 1986

[51] Int. Cl.[4] ..... F25D 17/08

[52] U.S. Cl. ..... 62/408; 239/587; 285/92; 285/187

[58] Field of Search ..... 62/408, 407, 382; 285/9.2, 189, 224; 239/587; 222/526; 361/383, 384; 98/115.4, 40.18

[56] References Cited

U.S. PATENT DOCUMENTS

| | | | |
|---|---|---|---|
| 1,351,368 | 8/1920 | Burns | 285/9.2 X |
| 1,588,320 | 6/1926 | Komarcsevits et al. | 285/9.2 X |
| 1,597,635 | 8/1926 | Stickdorn | 285/9.2 X |
| 3,403,533 | 10/1968 | Bollenbacher | 62/408 |
| 3,473,345 | 10/1969 | Pfeiffer et al. | 62/408 |
| 4,488,412 | 12/1984 | Weaver et al. | 62/408 X |
| 4,539,819 | 9/1985 | Alba et al. | 62/408 X |

*Primary Examiner*—William E. Tapolcai

*Attorney, Agent, or Firm*—William R. Clark; Richard M. Sharkansky

[57] ABSTRACT

A refrigerator having a cold air meat keeper that is adjustable to a plurality of alternate vertical positions. The cold air is introduced into the refrigerated food compartment through a port in the back wall of the liner. The meat keeper, which is suspended below a height-adjustable cantileverly-supported shelf, has an elastic conduit extending rearwardly therefrom. The conduit has an enlarged rear chamber that seals against the liner wall around the port in a plurality of elevational positions. The conduit is compressed in an interference fit to provide a positive sealing force against the liner surface.

12 Claims, 7 Drawing Figures

VERTICALLY-ADJUSTABLE MEAT KEEPER FOR REFRIGERATOR

BACKGROUND OF THE INVENTION

As is well known, refrigerator meat keepers are used to preserve meat at an optimum temperature which generally is 5°–8° F. cooler than the rest of the refrigerated food compartment. More specifically, meat keepers ideally maintain meat at a temperature which is just slightly above 32° F. One common embodiment for a meat keeper is defined by a meat container having an outer sheath or sleeve in which the container is slidably mounted. The sleeve is mounted within the refrigerated food compartment and the container may be pulled in and out for access to the interior. Air which is chilled at an appropriate temperature is directed into the sleeve from a conduit which is coupled to a cold air duct behind the rear wall liner of the refrigerated food compartment. Accordingly, the meat in the container is maintained at a temperature below the temperature of the refrigerated food compartment. Some of the chilled air in the sleeve may be directed into the meat container, but it is preferable that the percentage be relatively small and adjustable because too much chilled air passing over meat tends to dehydrate it, while too little tends to make it slimy.

As described in U.S. Pat. No. 4,539,819, issued Sept. 10, 1985, it is desirable to be able to reverse a meat keeper from one side to the other depending on which side the door is mounted. A prior art approach described therein was to provide a single port in the center of the back wall of the refrigerated food compartment and to couple a jointed arm conduit from the meat keeper to it; the conduit could then be rotated to either the left or the right depending on where the meat keeper was mounted. As described, such apparatus was difficult to align during a reversing procedure and the jointed arm encumbered the central rear portion of the refrigerated food compartment.

The improvement described in U.S. Pat. No. 4,539,819, was to provide a plenum behind the back wall of the refrigerated food compartment and have at least two spaced ports communicating from the plenum into the food compartment. Accordingly, in one mounting position of the meat keeper, a conduit from the meat keeper coupled to one of the ports while the other port was plugged. If the refrigerator door was reversed to the other side, the sides of the plug and the meat keeper were reversed so that the meat keeper received cold air from the opposite port. The liner around the ports was described as protruding slightly into the refrigerated food compartment to form a surrounding mound or ridge. The rear end of the conduit had a stepped collar which mated with the mound to provide a self-aligning junction that had sufficient sealing to direct substantially all of the chilled air from the duct through the port into the conduit.

Another problem with a refrigerator is that it may be desirable to move the meat keeper between alternate vertical positions. More specifically, the meat keeper is often associated with a shelf of the refrigerator and it may be desirable to change the vertical location of the meat keeper to adjust the available height above the respective shelves. For example, by moving the meat keeper up, taller food items can be stored on the shelf underneath the meat keeper.

SUMMARY OF THE INVENTION

It is an object of the invention to provide an air cooled meat keeper that is vertically adjustable.

It is another object to be able to move the meat keeper to an alternate vertical position without aligning air conveying mechanisms behind the meat keeper. It is also an object that the alignment and sealing of air conveying apparatus be provided automatically when the meat keeper is moved from one vertical position to an alternate vertical position.

Further, it is an object to provide an elastic conduit that connects to the meat keeper and extends rearwardly terminating in a chamber that has a height substantially larger than the height of a port in the refrigerator compartment liner through which chilled air is conveyed.

These and other objects are provided by the invention which defines a refrigerator comprising a refrigerator compartment having a back wall with a port, means for introducing cold air into the refrigerator compartment through the port, a meat keeper adapted for mounting in first and second alternate vertical positions in the refrigerator compartment, and a conduit for conveying the cold air from the port to the meat keeper, the conduit having a vertically elongated terminal for coupling the port to the meat keeper in both the first and second alternate vertical positions of the meat keeper. It may be preferable that the conduit be engaged to the meat keeper and extend horizontally rearwardly therefrom. Also, it may be preferable that the vertically elongated terminal comprise a rim which seals against the back wall peripherally around the port. Also, it may be preferable that the conduit be elastic for compressing in the horizontal direction to apply a positive sealing force for sealing the rim against the back wall.

The invention may also be practiced by a refrigerator comprising a refrigerator compartment having a back wall liner with a port, an air duct behind the back wall liner for providing cold air through said port into said refrigerator compartment, a meat keeper, means for mounting the meat keeper in first and second alternate vertical positions within said refrigerator compartment, a conduit coupled to the meat keeper and extending rearwardly therefrom for conveying the cold air from the port to the meat keeper, and the conduit having a rear chamber having a vertical height substantially greater than the height of the port for communicating with the port in both the first and second vertical positions of the meat keeper. It may be preferable that the mounting means comprise slotted support tracks vertically extending in the refrigerator compartment for cantileverly supporting the meat keeper. Also, the surface of the back wall liner surrounding the port may preferable be planar and the rear chamber of the conduit be defined by a band having a rearwardly extending rim which contacts the substantially planar surface of the back wall liner surrounding the port. Further, the conduit may be an elastic material in a compressed interference fit between the meat keeper and the back wall liner for providing a sealing force against the back wall liner. The meat keeper may preferably define a container having an outer sleeve suspended under a refrigerator shelf. The cold air may be introduced into the region between the container and the sleeve. By alternate vertical positions, it may be generally meant that the shelf may be moved to alternate mounting heights within the refrigerator compartment wherein the mounting height of the meat keeper is varied.

The invention further defines a refrigerator comprising a refrigerator compartment having a back wall liner with a stationary port, an air duct behind the back wall liner communicating with the stationary port, means for providing cold air into the air duct for introduction into the refrigerator compartment through the port, a meat keeper having a rearwardly extending conduit for receiving the cold air from the port, means for mounting the meat keeper in first and second alternate vertical positions within the refrigerator compartment, and the conduit having a rear terminal chamber defined by a flexible lateral wall with a rearwardly extending rim for sealing against the back wall liner around the port, the chamber having a vertical height substantially larger than the height of the port wherein the conduit communicates with the port in both the first and second positions of the meat keeper. It may be preferable that the mounting means comprise slotted vertical tracks vertically positioned in the refrigerator compartment for cantileverly supporting the meat keeper. By having a vertical height substantially larger than the height of the port, it may generally mean that the chamber is larger than the port by a distance at least greater than the spacing between two adjacent slots on the vertical tracks. It may be preferable that the vertical height of the chamber be larger than three inches. It may be preferable that the port have a vertical dimension of less than one inch.

BRIEF DESCRIPTION OF THE DRAWINGS

The foregoing objects and advantages will be more fully understood by reading the Description of the Preferred Embodiment with reference to the drawings wherein.

DESCRIPTION OF THE PREFERRED EMBODIMENT

Figure 1:
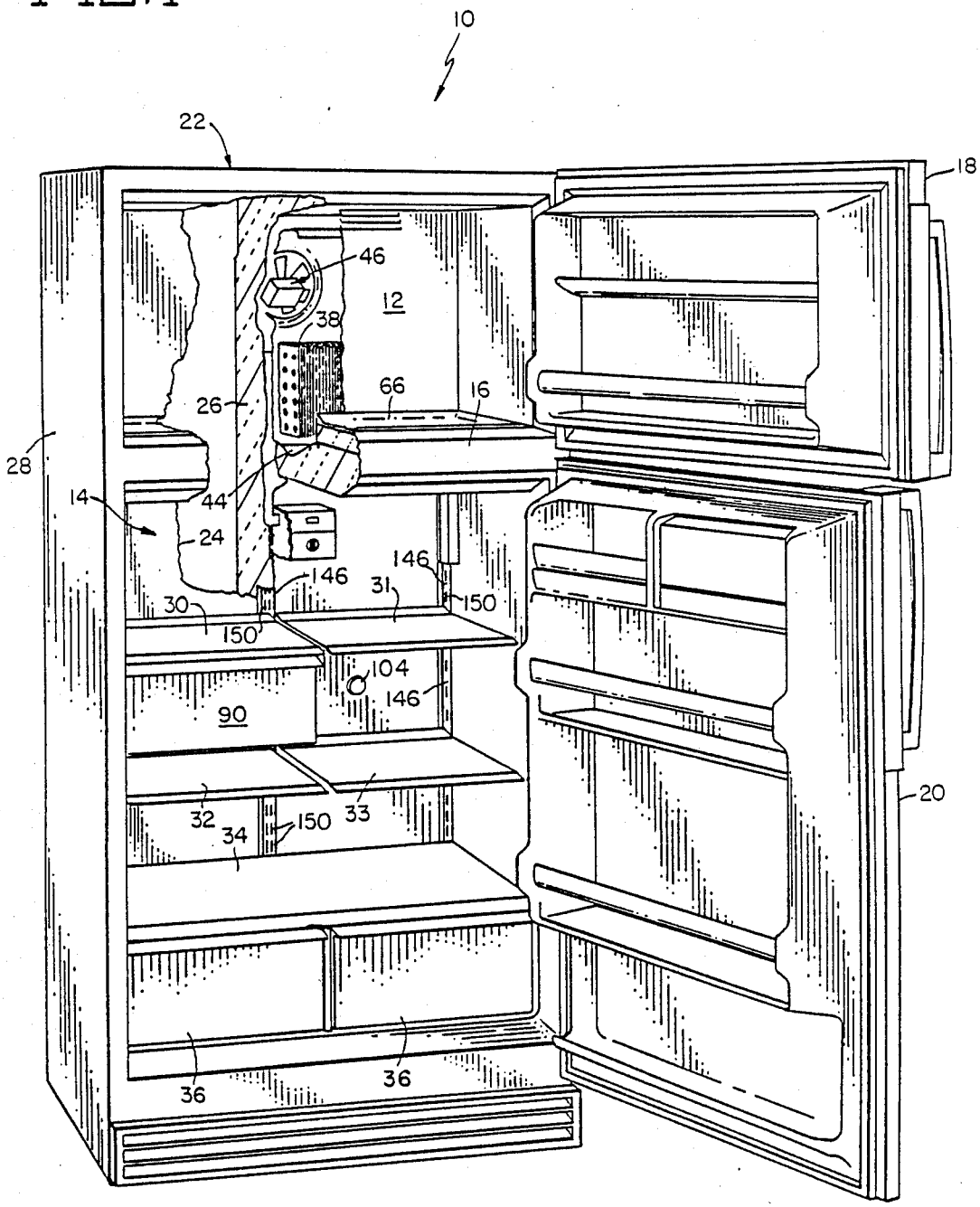
FIG. 1 is a partially broken away perspective view of a "top mount" refrigerator.
Figure 2:
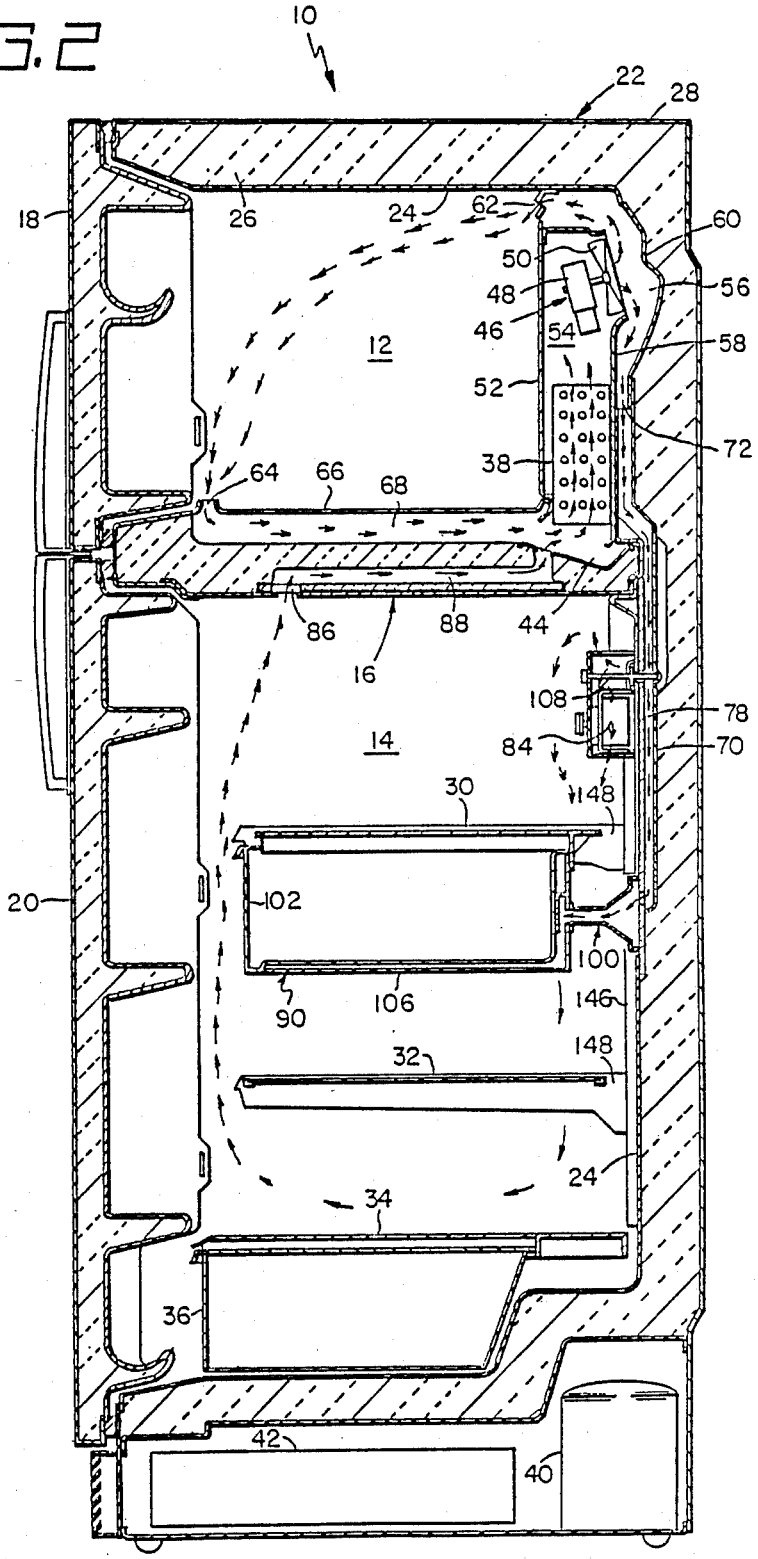
FIG. 2 is a side sectioned view of the refrigerator including side views of the controls and the meat keeper.
Figure 3:
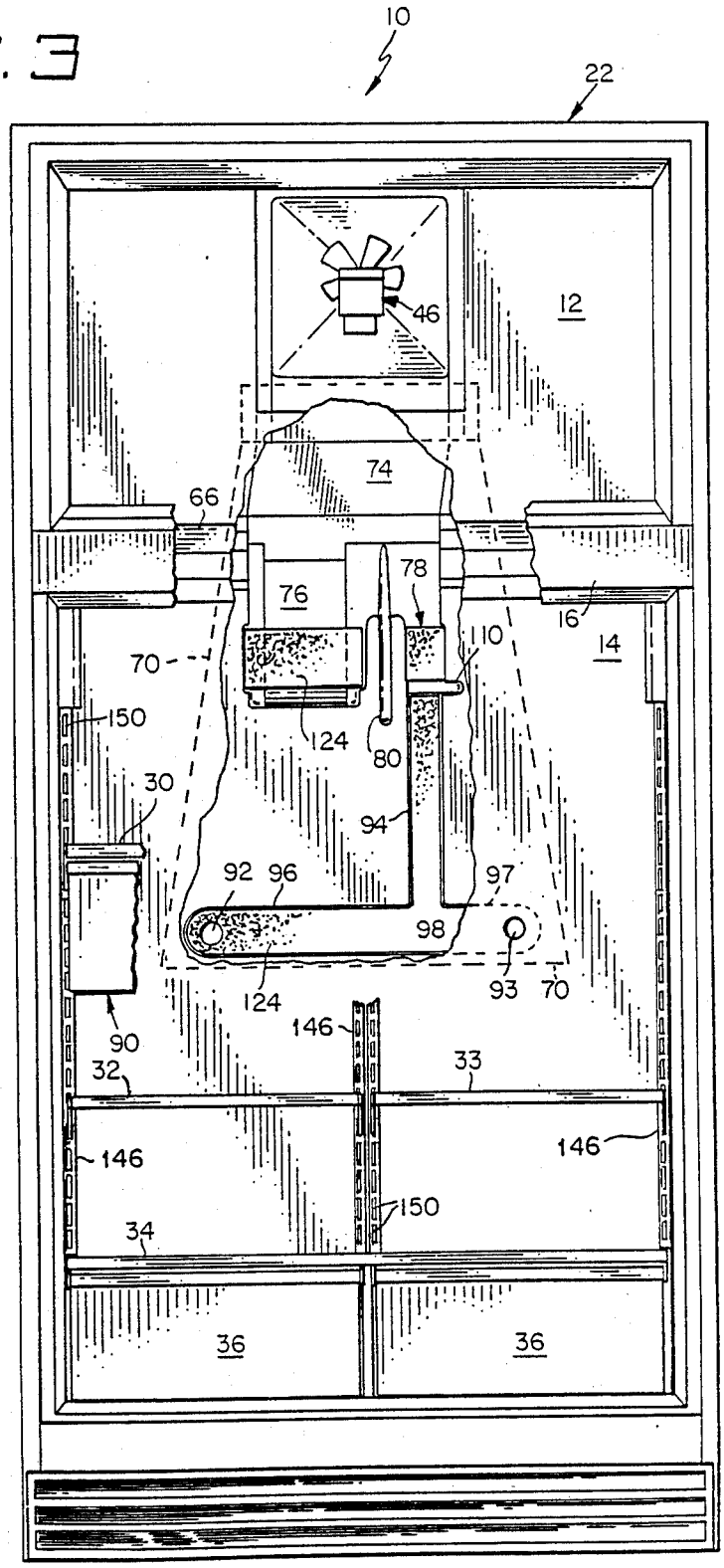
FIG. 3 is a partially broken away front view of the refrigerator with the doors removed.

Referring to FIGS. 1–3, various views of refrigerator 10 are shown. Refrigerator 10 here shown as a "top mount" refrigerator is divided into a top freezer compartment 12 and bottom refrigerated food compartment 14 by a horizontal partition 16. Door 18 closes freezer compartment 12 and door 20 closes refrigerated food compartment 14. Here, both doors 18 and 20 are shown hinged on the right side of the refrigerator cabinet 22. The cabinet 22 of refrigerator 10 generally defines a plastic liner 24 surrounded by insulation 26 which is encased by an outer shell 28 or case. As is conventional, shelves 30–34 and crisper pans 36 are mounted in the refrigerated food compartment 14.

As is well known and as shown in FIG. 2, the components of a refrigeration loop consist of an evaporator 38, compressor 40, condenser 42 and expansion valve or capillary tube (not shown). Although the interconnecting tubes of the refrigeration loop are not shown, a working fluid or refrigerant is cycled through these components such that heat is extracted from air passing across evaporator 38 to support the evaporation therein. As is shown in FIG. 2, water condensed on evaporator 38 falls into trough 44 where it is collected and carried away by a tube (not shown). Air is drawn across evaporator 38 by fan 46 which consists of a fan motor 48 and fan blades 50. Fan 46 is located behind the rear wall 52 of freezer compartment 12 in evaporator chamber 54. Fan 46 directs the chilled air from the evaporator chamber 54 into chamber 56 which is defined by panel 58 and liner 24. Chilled air from fan 46 impinges on dimple 60 formed in liner 24 so as to reduce static air pressure build-up by keeping the air moving radially therefrom. Chilled air directed upward in chamber 56 passes through outlet 62 in the rear wall 52 of the freezer compartment 12. Fan 46 draws air back from freezer compartment 12 through inlet 64 in the floor 66 of the freezer compartment 12 and passageway 68 in horizontal partition 16. The controls for cycling compressor 40 and fan 46 on and off are conventional and are generally determined as a function of the operator setting and the temperature of freezer compartment 12.

In general, liner 24 and shroud 70 may be a vacuum formed using a plastic material such as ABS. The shape of shroud 70 is generally defined by the dotted line so identified in FIG. 3. Shroud 70 is connected to the back of liner 24 and taped in place to provide an air seal between the two. With the liner 24 inserted in outer shell 28 or case, foam such as polystyrene is injected into the spacing therebetween to form the layer of insulation 26. An aperture 72 in liner 24 provides communication between chamber 56 and air duct 74 between the back of liner 24 and shroud 70. More specifically, as is well known, shroud 70 is contoured so as to provide a pattern of air passageways from chamber 56 behind the liner 24 down to the refrigerated food compartment 14.

Behind the liner 24 wall in the refrigerated food compartment 14, air duct 74 formed by shroud 70 divides into air duct branches 76 and 78 as shown in FIG. 3. Hollow 80 which appears to be a third branch is actually used to house a sensor which forms no part of the present invention. Branch 76 communicates through aperture 82 to conventional damper or baffle control 84 which is shown in detail in FIG. 4. As is well known, damper control 84 opens and closes the passageway from aperture 82 into refrigerated food compartment 14 as a function of the operator setting and the sensed temperature. More specifically, when chilled air is called for, damper control 84 opens and when the refrigeration cycle starts as determined by the freezer control, chilled air directed downward from dimple 60 by fan 46 passes through chamber 56, air duct 74, branch 76, aperture 82 and the baffle control 84 into refrigerated food compartment 14. The air from the refrigerated food compartment 14 recirculates back to evaporator chamber 54 via inlet 86 and passageway 88 as shown by the arrows in FIG. 2. The apparatus and operative principles described heretofore are conventional.

As described in U.S. Pat. No. 4,539,819, it may be desirable to reverse the side of meat keeper 90 depending on which side door 20 is mounted. In such case, air duct branch 78, which is used to channel chilled air to meat keeper 90, may preferably have a plurality of ports 92 and 93 into refrigerated food compartment 14. More specifically, as shown in FIG. 3, air duct branch 78 or plenum defines a trunk 94 which divides into two horizontal extending air duct legs 96 and 97. Ports 92 and 93 may preferably be ¾-inch circular apertures through the back wall of liner 24 which is flat or planar in the region peripheral thereto. As shown in FIGS. 1–3, meat keeper 90 is positioned on the left side of the refrigerated food compartment 14 because door 20 is hinged on the right side of cabinet 22. In this configuration, throat or conduit 100 communicates between port 92 and meat keeper 90 so that chilled air is circulated around meat container 102 as will be described in more detail later herein. In such case, suitable cover 104 or plug is placed in port 93 to block the flow of chilled air from passing down the right air duct leg 97 into refrigerated food compartment 14.

Any suitable meat keeper 90 which operates with a flow of chilled air could be used. For a detailed description of an illustrative example, see U.S. Pat. No. 3,473,345, issued Oct. 21, 1969, which is hereby incorporated by reference. Briefly, the chilled air may pass between a sleeve 106 and the meat container 102 thereby maintaining the interior temperature of the meat keeper 90 approximately 5°–8° F. cooler than the rest of the refrigerated food compartment which may, for example, typically be in the range from 38°–40° F. As is well known, fresh meat keeps best at a temperature just slightly above the freezing point of water. If too much air circulates over the meat, it may cause dehydration. On the other hand, if too little air circulates over meat, it may become slimy. Accordingly, it may be preferable that a small adjustable percentage of the chilled air in the sleeve 106 pass through the meat container 102.

Figure 4:
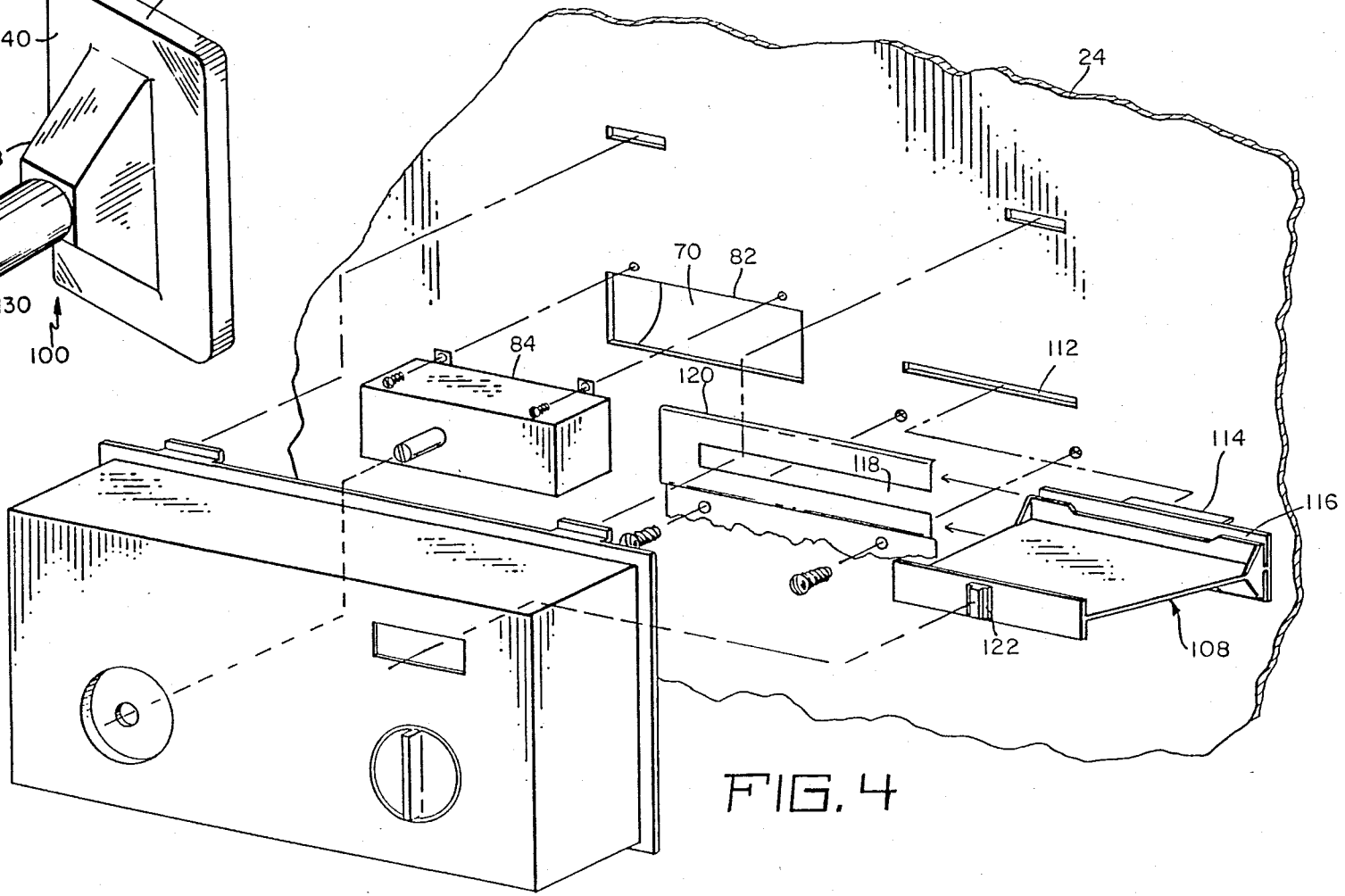
FIG. 4 is an exploded perspective view of the controls for the refrigerated food compartment and the meat keeper.

Referring to FIG. 4, the temperature of meat keeper 90 is regulated by sliding gate valve 108. More specifically, shroud 70 is formed so that air duct branch 78 has a horizontal notch 110 aligned with slot 112 in liner 24. Sliding gate valve 108 has a slide gate 114 which inserts through slot 112 in liner 24. On the refrigerated food compartment 14 side of liner 24, slide gate valve 108 is supported by having a groove 116 which seats in and engages guide slot 118 of bracket 120. Using handle 122, the operator can push slide gate valve 108 laterally in guide slot 118. In the left-most position as shown in FIG. 4, slide gate 114 blocks branch 78 preventing the flow of chilled air to meat keeper 90. In the right-most position, slide gate 114 is totally within notch 110 so that it has no affect on the flow of chilled air to meat keeper 90. At varying positions in between, slide gate 114 shuts off the flow of chilled air to meat keeper 90 in varying amounts. Bars 124 of foam insulation are positioned in air duct branches 76 and 78 between liner 24 and the chilled air paths as shown.

Figure 5:
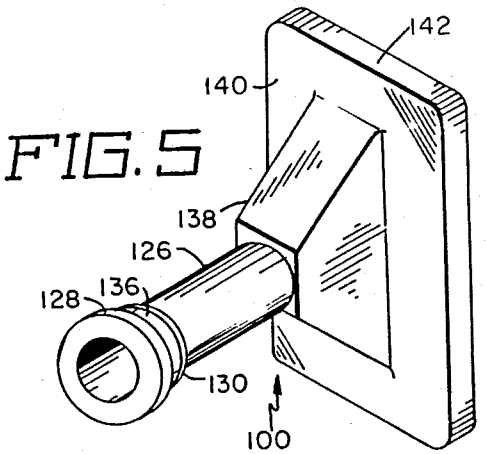
FIG. 5 is a perspective view of the conduit for coupling chilled air to the meat keeper.
Figure 6:
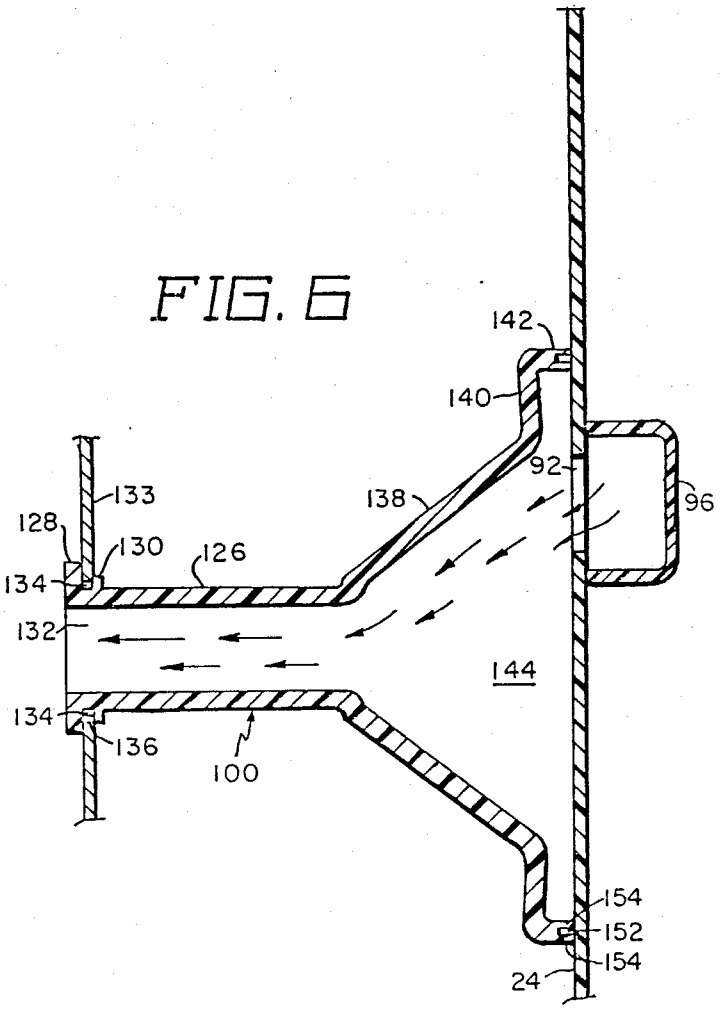
FIG. 6 is a side sectioned view of the conduit and its terminal members in one elevational position of the meat keeper.
Figure 7:
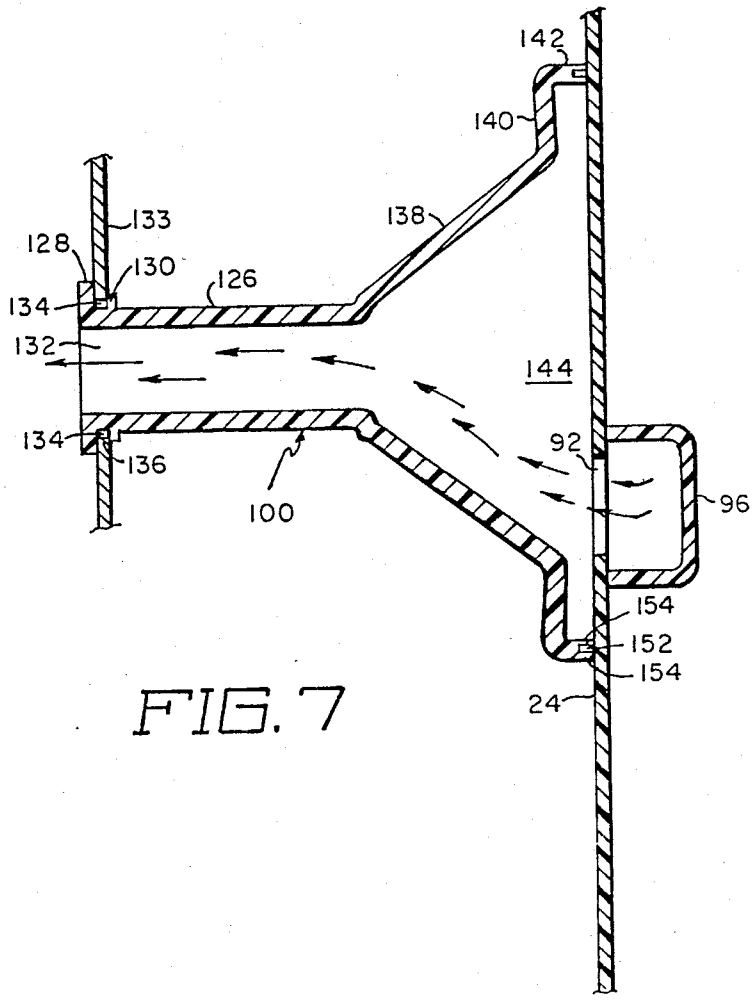
FIG. 7 is the same view as FIG. 6 with the meat keeper in an alternate elevational position.

Referring to FIG. 5, there is a perspective view of conduit 100 which functions to couple chilled air from either port 92 or 93 to meat keeper 90. In accordance with the invention, conduit 100 enables meat keeper 90 to be mounted at a plurality of alternate vertical positions and still receive chilled air from either port 92 or port 93, depending on which side meat keeper 90 is mounted. More specifically, FIGS. 6 and 7 show side sectioned views of conduit 100 communicating between a port 92 or 93 and sleeve 106 of meat keeper 90. Conduit 100 may preferably be rubber or injection-molded from a flexible plastic such as PVC. On the end that mates with meat keeper 90, conduit 100 defines a cylinder 126 having spaced flanges 128 and 130 which snuggly engage the back wall 133 of sleeve 106 after flange 128 is snapped through circular aperture 132. Accordingly, conduit 100 is securely connected to meat keeper 90 and extends horizontally therefrom in a rearward direction. Two keys 134 in the groove 136 between flanges 128 and 130 mate with detents (not shown) in circular aperture 132 to prevent conduit 100 from rotating about the axis of cylinder 126.

From cylinder 126 which may have an internal diameter of ¾ of an inch, conduit 100 enlarges in the vertical direction to form a rectangular transition section 138. For example, the internal vertical height of transition section 138 may enlarge to 3 inches. Transition section 138 couples to a wall which is relatively flexible and extends outwardly defining a ¾-inch band 140 around transition section 138. Band 140 has a right angle rim 142 which extends rearwardly for approximately ⅜ of an inch. Accordingly, there is a terminal chamber 144 defined inside rim 142, and it may preferably have a vertical height of approximately 4½ inches and a width of approximately 2¼ inches. In accordance with the invention, meat keeper 90 with conduit 100 securely attached thereto may be moved up and down several inches and still communicate with port 92 or 93. For example, in FIG. 6, the elevation of meat keeper 90 and conduit 100 is relatively low such that port 92 or 93 communicates with the top section of terminal chamber 144. In FIG. 7, the elevation of meat keeper 90 and conduit 100 is relatively high such that port 92 or 93 communicates with the bottom section of terminal chamber 144.

In conventional manner, shelf 30, like the other shelves, is supported in cantilever fashion by shelf support track 146 running vertically along the back of liner 24. Shelf 30 also has sleeve 106 connected integrally thereto and suspended underneath. In order to alter the mounted elevation of meat keeper 90, meat container 102 is first removed and then the braces 148 of shelf 30 are moved to different slots 150 of support track 146. Typically, the slots 150 may be vertically spaced by an inch or an inch and a half. Accordingly, for the dimensions given in the example herein, meat keeper 90 could be supported in three or four alternate vertical positions with conduit 100 still mating with and conveying chilled air from either port 92 or 93.

Rim 142 may have a peripheral channel 152 or groove defining two thin parallel ridges 154 to improve the sealing against the back of liner 24. More specifically, channel 152 may provide a double seal and also makes the ridges thinner than the rim thereby increasing the flexibility. Also, sealing conduit 100 to the back of liner 24 around port 92 or 93 is improved by giving conduit 100 an interference fit between the back wall 133 of sleeve 106 and the back wall of liner 24. More specifically, by making conduit 100 approximately 0.060 to 0.090 inches longer than the spacing between the members it communicates between, conduit 100 slightly compresses to provide a positive sealing force for rim 142 against the surface of the back wall of liner 24. Conduit 100 is an elastic material and the compression preferably results in a slight bend at the junction between transition section 138 and band 140 as shown in FIGS. 6 and 7.

Because meat keeper 90 and its shelf 30 can be mounted at a plurality of alternate vertical positions, the heights above shelves 30 and 32 can be optimized according to the desire of the user to reduce unused storage space. Further, as described in U.S. Pat. No. 4,539,819, meat keeper 90 can be reversed so as to be mounted on either side depending on the mounting side of door 20. If moved to the right as shown in FIG. 1, plug 104 is removed and meat keeper 90 is moved to the right where it couples to port 93 instead of 92. Then, the plug 104 is positioned in port 92. In altering the position of meat keeper 90 either vertically or horizontally, conduit 100 provides self-alignment and sealing to the respective port, 92 or 93. In other words, without resorting to the need for reaching behind meat keeper 90 to align air conveying mechanisms, the user can merely move meat keeper 90 right or left, up or down, without concern about obtaining an effective seal, so long as it is within the vertical limits of conduit 100.

This concludes the Description of the Preferred Embodiment. Those skilled in the art will realize that there are many alterations and modifications possible without departing from the spirit and scope of the invention. For example, conduit 100 could be formed in the shape of a shoe which extends vertically in only one direction from the axis of cylinder 126. Further, the direction could be altered by axially rotating the conduit 100 about its axis to provide a greater range of available mounting positions. Accordingly, it is intended that the scope of the invention be limited only by the appended claims.

What is claimed is:

1. A refrigerator comprising:

a refrigerator compartment having a back wall with a port;

means for introducing cold air into said refrigerator compartment through said port;

a meat keeper adapted for mounting in first and second alternate vertical positions in said refrigerator compartment; and a conduit for conveying said cold air from said port to said meat keeper, said conduit having a vertically elongated terminal for coupling said port to said meat keeper in both said first and second alternate vertical positions of said meat keeper.

2. The refrigerator recited in claim 1 wherein said conduit is engaged to said meat keeper and extends horizontally rearwardly therefrom.

3. The refrigerator recited in claim 2 wherein said vertically elongated terminal comprises a rim which seals against said back wall peripherally around said port.

4. The refrigerator recited in claim 3 wherein said conduit is elastic for compressing in the horizontal direction to apply a positive sealing force for sealing said rim against said back wall.

5. A refrigerator comprising:

a refrigerator compartment having a back wall liner with a port;

an air duct behind said back wall liner for providing cold air through said port into said refrigerator compartment;

a meat keeper;

means for mounting said meat keeper in first and second alternate vertical positions within said refrigerator compartment;

a conduit coupled to said meat keeper and extending rearwardly therefrom for conveying said cold air from said port to said meat keeper; and said conduit having a rear chamber having a vertical height substantially greater than the height of said port for communicating with said port in both said first and second vertical positions of said meat keeper.

6. The refrigerator recited in claim 5 wherein said mounting means comprises slotted support tracks vertically extending in said refrigerator compartment for cantileverly supporting said meat keeper.

7. The refrigerator recited in claim 5 wherein the surface of said back wall liner surrounding said port is substantially planar and said rear chamber of said conduit is defined by a band having a rearwardly extending rim which contacts said substantially planar surface of said back wall liner surrounding said port.

8. The refrigerator recited in claim 7 wherein said conduit is an elastic material in a compressed interference fit between said meat keeper and said back wall liner for providing a sealing force against said back wall liner.

9. A refrigerator comprising:

a refrigerator compartment having a back wall liner with a stationary port;

an air duct behind said back wall liner communicating with said stationary port;

means for providing cold air into said air duct for introduction into said refrigerator compartment through said port;

a meat keeper having a rearwardly extending conduit for receiving said cold air from said port and conveying it to said meat keeper;

means for mounting said meat keeper in first and second alternate vertical positions within said refrigerator compartment; and said conduit having a rear terminal chamber defined by a flexible lateral wall with a rearwardly extending rim for sealing against said back wall liner around said port, said chamber having a vertical height substantially larger than the height of said port wherein said conduit communicates with said port in both said first and second positions of said meat keeper.

10. The refrigerator recited in claim 9 wherein said mounting means comprises slotted vertical tracks vertically positioned in said refrigerator compartment for cantileverly supporting said meat keeper.

11. The refrigerator recited in claim 9 wherein said vertical height of said chamber is larger than three inches.

12. The refrigerator recited in claim 9 wherein said port has a vertical dimension of less than one inch.

* * * * *